US005215447A

United States Patent [19]

Wen

[11] Patent Number: 5,215,447

[45] Date of Patent: Jun. 1, 1993

[54] MINI-TYPE AIR COMPRESSOR

[76] Inventor: San-Jou Wen, P.O. Box 82-144, Taipei, Taiwan

[21] Appl. No.: 905,371

[22] Filed: Jun. 26, 1992

[51] Int. Cl.[5] ..... F04B 35/04; F16J 1/10

[52] U.S. Cl. ..... 417/415; 417/319; 92/129

[58] Field of Search ..... 417/415, 319; 92/129, 92/DIG. 4

[56] References Cited

U.S. PATENT DOCUMENTS 3,347,451 10/1967 Vind ..... 417/319
3,484,822 12/1969 Leffers ..... 417/319
3,518,031 6/1970 Randall ..... 417/319

*Primary Examiner*—Richard A. Bertsch
*Assistant Examiner*—Roland McAndrews
*Attorney, Agent, or Firm*—Alfred Lei

[57] ABSTRACT

This invention relates to a mini-type air compressor and in particular to one which includes a motor having a driving axle connected with a driving gear, a fixed seat on which is fixedly mounted the motor, a transmission gear having an enlarged threaded portion and meshed with the driving gear of the motor, a cylinder mounted on the fixed seat, an eccentric member provided with a shaft extending through the transmission gear to engage with the fixed seat so that one side of the eccentric member is spaced apart from the enlarged threaded portion of the transmission gear and the transmission gear must rotate through a certain distance before that side contacts and pushes the eccentric member to rotate, and a spring mounted between the transmission gear and the eccentric member for pushing the eccentric gear to contact another side of the enlarged threaded portion of the transmission gear.

1 Claim, 5 Drawing Sheets

MINI-TYPE AIR COMPRESSOR

BACKGROUND OF THE INVENTION

It has been found that the prior art mini-type air compressor on the market utilizes a motor to drive a piston to compress air. However, when the compressor is turned on, the motor will immediately drive the piston to reciprocate in a cylinder thereby producing a relatively large transient current through the motor and therefore shortening its working life.

Therefore, it is an object of the present invention to provide an improved mini-type air compressor which may obviate and mitigate the above-mentioned drawbacks.

SUMMARY OF THE INVENTION

This invention relates to an improved mini-type air compressor.

It is the primary object of the present invention to provide a mini-type air compressor which may reduce the transient current through the motor when started.

It is another object of the present invention to provide a mini-type air compressor which may prevent the motor from being burnt down by the transient current.

It is still another object of the present invention to provide a mini-type air compressor which is durable in use.

It is still another object of the present invention to provide a mini-typed air compressor which is simple in construction.

It is a further object of the present invention to provide a min-typed air compressor which is easy to manufacture.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
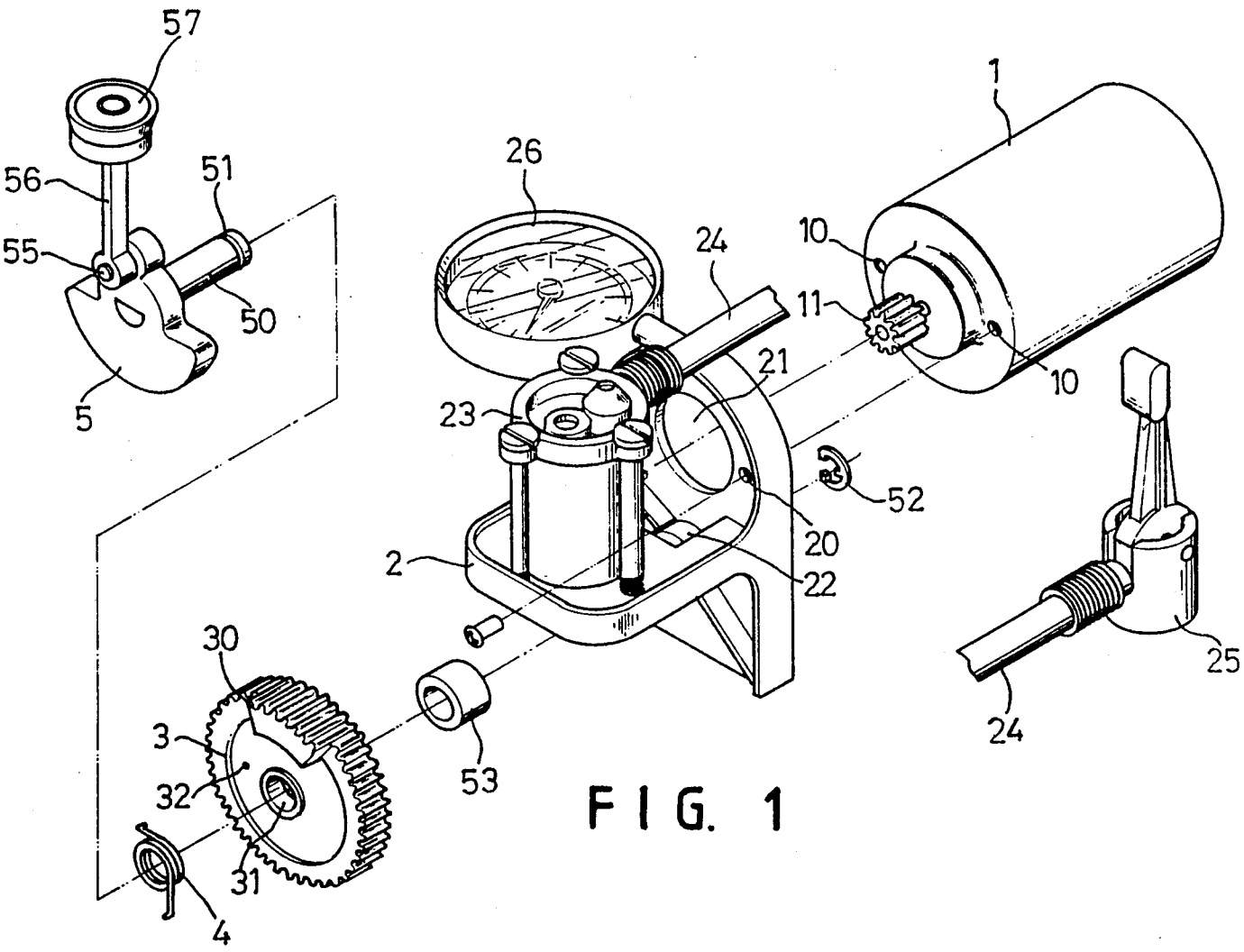
FIG. 1 is an exploded view of a mini-type air compressor according to the present invention.
Figure 2:
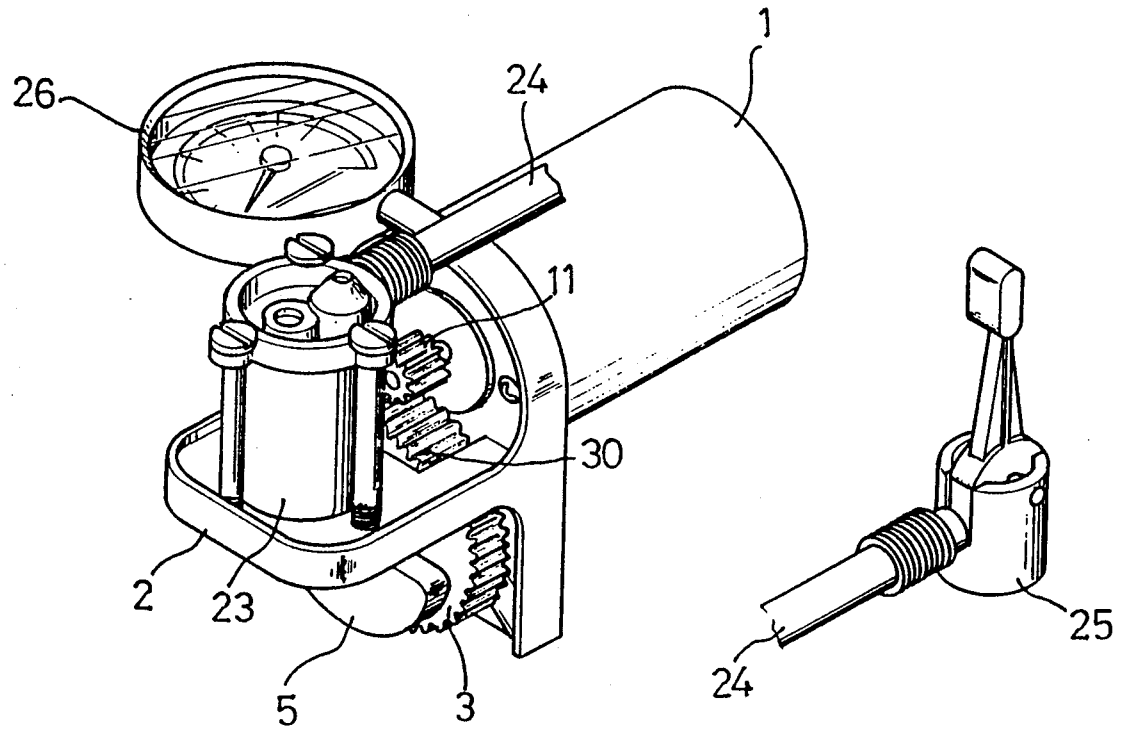
FIG. 2 is a perspective view of the mini-type air compressor.
Figure 4:
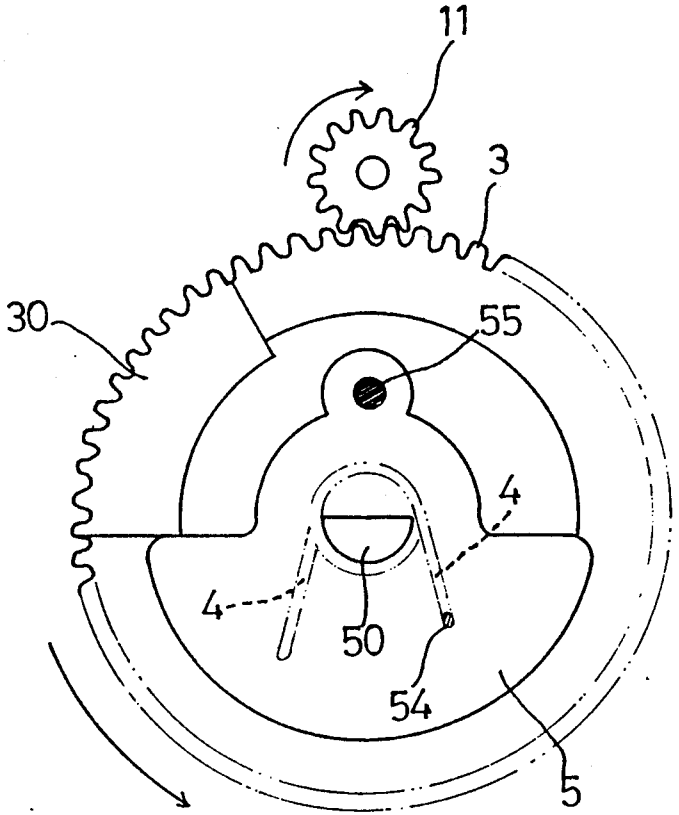
FIGS. 3–8 show the working principle of the present invention.
Figure 3:
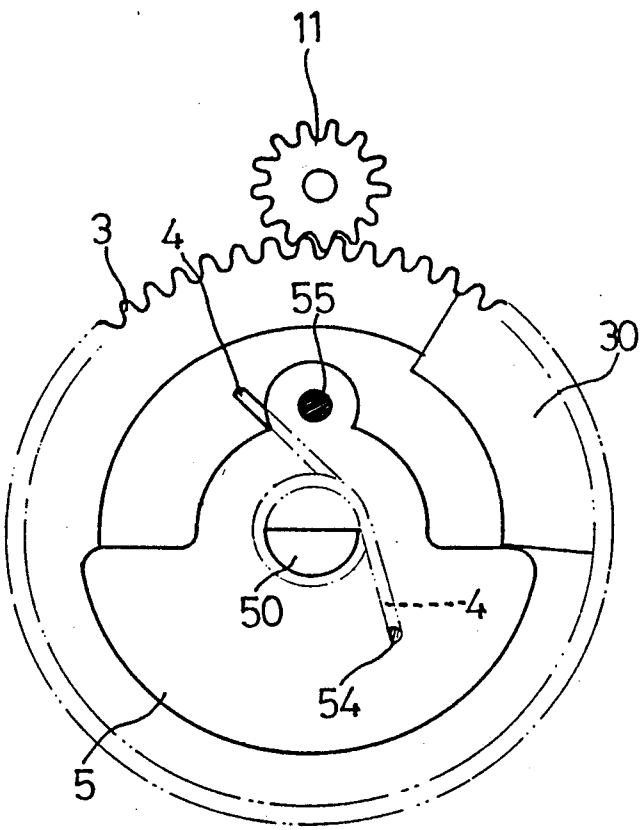
Figure 6:
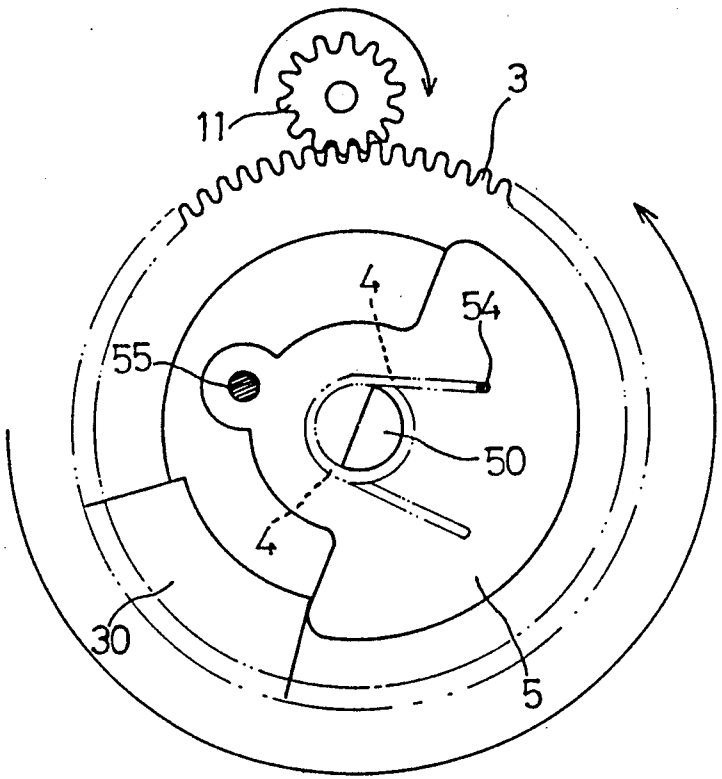
Figure 5:
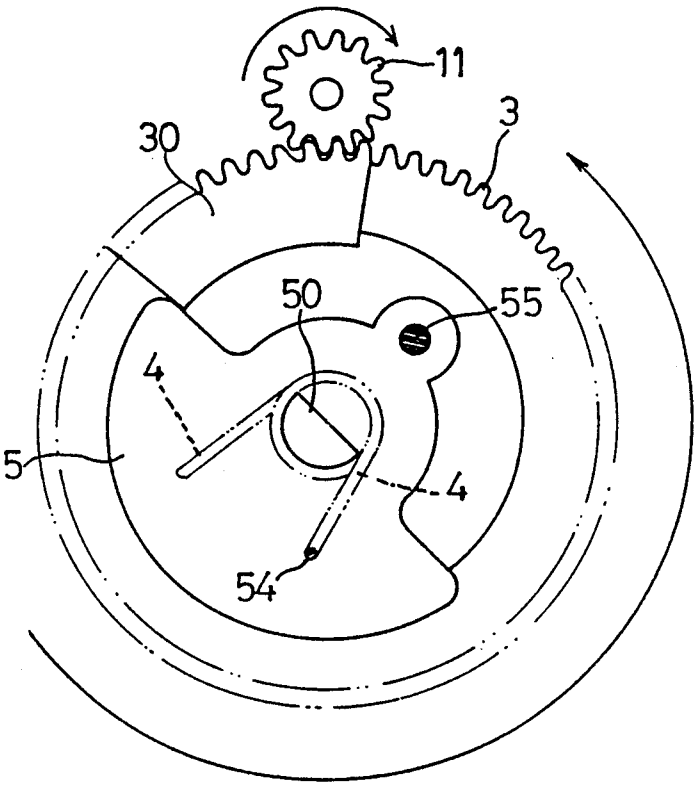
Figure 8:
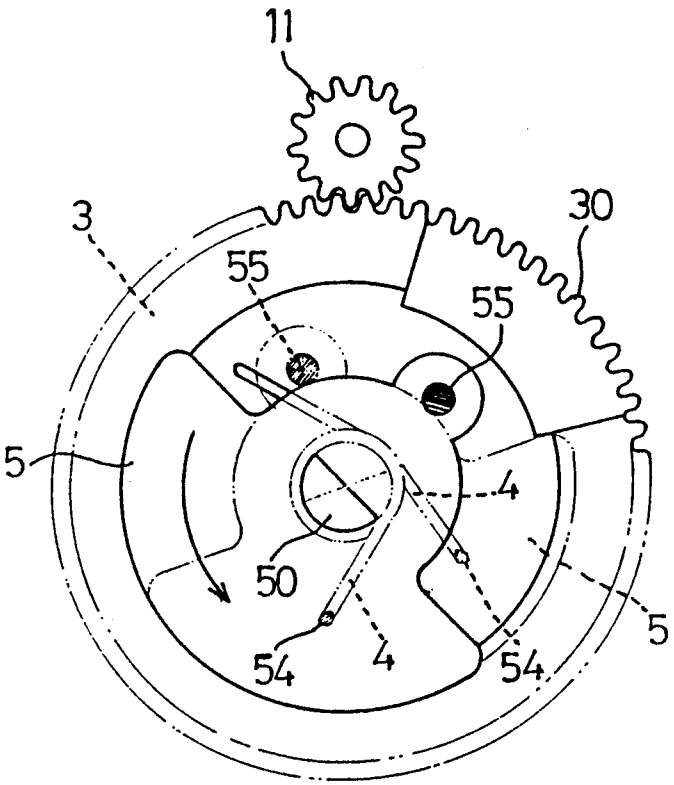
Figure 7:
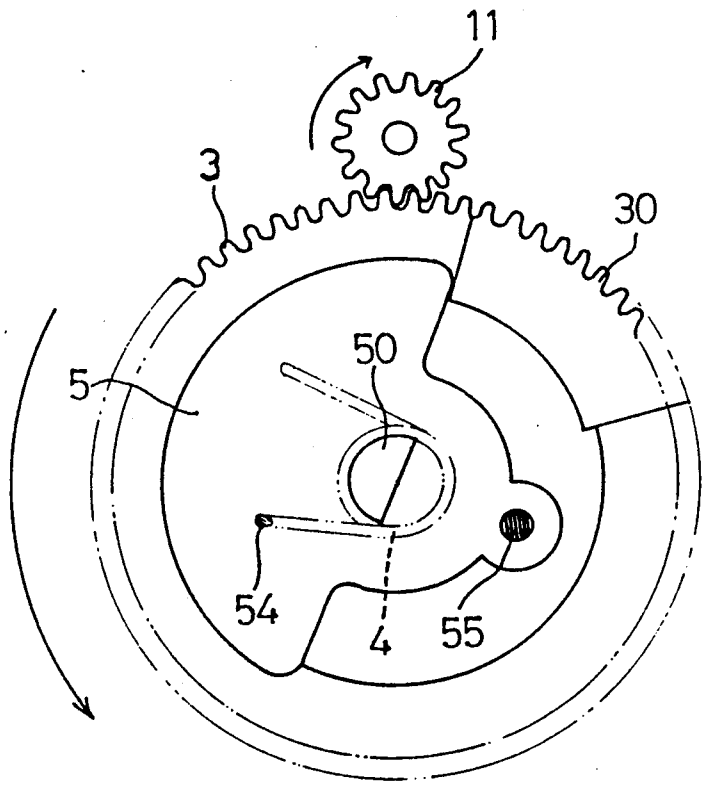

With reference to the drawings and in particular to FIG. 1 thereof, the mini air compressor according to the present invention mainly comprises a motor 1, a fixed seat 2, a transmission gear 3, a spring 4, and an eccentric block 5.

The motor 1 is provided with two threaded holes 10 on the housing and a driving axle connected with a driving gear 11.

The fixed seat 2 is provided with two threaded holes 20 in alignment with the threaded holes 10 of the motor 1, and opening 21 for the passage of the driving gear 11, and a slot 22 under the opening 21. A cylinder 23 is mounted on the fixed seat 2 and connected to a nozzle 25 via a pipe 24. Further, the pipe 24 is connected with a pressure gauge 26 for measuring the pressure at a given point.

The transmission gear 3 has an enlarged threaded portion 30, a center hole 31 and a recess 32.

The spring 4 is mounted between the recess 32 of the transmission gear 3 and a recess 54 of the eccentric block 5.

The eccentric member 5 is provided with a shaft 50 with an annular groove 51 at the distal end for engaging with a retainer ring 52 so that the shaft 50 extends through the spring 4, the center hole 31 of the transmission gear 3, a sleeve 53, and the slot 22 of the fixed seat 2 to engage with the fixed seat 2. The eccentric member 5 is provided at one side with a recess 54 for receiving the spring 4 and at the other with a protuberance 55 for connecting with a linking rod 56 which is in turn connected with a piston 57.

In assembly, first pass the driving gear 11 of the motor 1 through the opening 21 of the fixed seat 2 and then fixedly mount the motor 1 on the fixed seat 2 by bolts engaged with the holes 20 of the fixed seat 2 and the holes 10 of the motor 1. Then, put the shaft 50 of the eccentric member 5 through the spring 4, the center hole 31 of the transmission gear 3, and the sleeve 53 to engage the retainer ring 52 with its annular groove 51 thereby joining the eccentric member 5 and the fixed seat 2 together. Thereafter, the two ends of the spring 4 are engaged with the recess 32 of the transmission gear 3 and the recess 54 of the eccentric member 5 so that the transmission gear 3 may be moved in unison with the eccentric member 5. The transmission gear 3 is meshed with the driving gear 11 of the motor 1. As the motor 1 is turned on, the driving gear 11 will drive the transmission gear 3 to rotate which will in turn rotate the shaft 50 thereby causing the piston 57 to reciprocate along the interior of the cylinder 23 via the linking rod 56 and the protuberance 55.

FIGS. 3, 4, 5, 6, 7 and 8 show the working principle of the present invention. As illustrated, when the motor 1 is turned on, the driving gear 11 will drive the transmission gear 3 to rotate through a certain distance before the enlarged threaded portion 30 of the transmission gear 3 contacts and pushes the eccentric member 5 to move in unison with the transmission gear 3 so that the piston 57 will reciprocate along the interior of the cylinder 23 via the linking rod 56 and the protuberance 55 thus producing compressed air and transmitting the compressed air to the nozzle 25 via the pipe 24. In the meantime, the pressure gauge 26 will show the pressure of the compressed air.

As the motor 1 is turned off, the driving gear 1 will stop rotating and the eccentric member 5 will be pushed by the spring 4 to go to contact the other side of the enlarged threaded portion 30 of the transmission gear 3.

In conclusion, the transmission gear 3 will not drive the eccentric member 5 to rotate to acutate the piston 57 until its enlarged threaded portion 30 is in contact with the eccentric member 5 so that the transient current through the motor 1 will not be reduced thereby preventing the motor 1 from being burnt down and therefore prolonging the working life thereof.

Although the present invention has been described with a certain degree of particularity, it is understood that the present disclosure is made by way of example only and that numerous changes in the detail of construction and the combination and arrangement of parts may be resorted to without departing from the spirit and scope of the invention and hereinafter claimed.

I claim:

1. A mini-type air compressor:

a motor having a driving axle connected with a driving gear;

a fixed seat on which is fixedly mounted said motor;

a transmission gear having an enlarged threaded portion and meshed with the driving gear of said motor;

a cylinder mounted on said fixed seat;

an eccentric member provided with a shaft extending through said transmission gear to engage with said fixed seat so that one side of said eccentric member is spaced apart from the enlarged threaded portion of said transmission gear and said transmission gear must rotate through a certain distance before said side contacts and pushes said eccentric member to rotate, said eccentric member being connected via a linking rod with a piston disposed within said cylinder; and a spring mounted between said transmission gear and said eccentric member for pushing said eccentric gear to contact another side of the enlarged threaded portion of said transmission gear.

* * * * *